US005611500A

United States Patent [19]

Smith

[11] Patent Number: 5,611,500

[45] Date of Patent: Mar. 18, 1997

[54] REEL WOUND ROLL LOAD SENSING ARRANGEMENT

[75] Inventor: Philip W. Smith, Beloit, Wis.

[73] Assignee: Beloit Technologies, Inc., Wilmington, Del.

[21] Appl. No.: 528,186

[22] Filed: Sep. 14, 1995

Related U.S. Application Data

[63] Continuation of Ser. No. 196,888, Feb. 15, 1994, abandoned, which is a continuation of Ser. No. 889,882, May 29, 1992, abandoned.

[51] Int. Cl.[6] ..... B65H 18/14; B65H 18/26

[52] U.S. Cl. ..... 242/541.4; 242/534; 242/542.3

[58] Field of Search ..... 242/541.4, 541.7, 242/541.5, 541.6, 534, 542.3

[56] References Cited

U.S. PATENT DOCUMENTS

| | | | |
|---|---|---|---|
| 2,194,078 | 3/1940 | Simonds | 242/65 |
| 2,582,429 | 1/1952 | Haswell | 242/65 |
| 2,691,326 | 10/1954 | McArn | 92/49 |
| 3,032,245 | 5/1962 | George et al. | 226/39 |
| 3,258,217 | 6/1966 | MacArthur et al. | 242/65 |
| 3,687,388 | 8/1972 | Pfeiffer | 242/65 |
| 3,743,199 | 7/1973 | Karr et al. | 242/65 |
| 3,837,593 | 9/1974 | Dörfel | 242/66 |
| 4,191,341 | 3/1980 | Looser | 242/67.1 R |
| 4,227,658 | 10/1980 | Justus | 242/66 |
| 4,458,853 | 7/1984 | Heymanns | 242/56 |
| 4,549,701 | 10/1985 | Lucas | 242/75 |
| 4,552,317 | 11/1985 | Halter | 242/65 |
| 4,726,532 | 2/1988 | Holm | 242/65 |
| 4,742,968 | 5/1988 | Young, Jr. et al. | 242/65 |
| 4,979,689 | 12/1990 | Snygg | 242/65 |
| 5,022,597 | 6/1991 | Morizzo | 242/56 |

FOREIGN PATENT DOCUMENTS

| | | |
|---|---|---|
| 0394197 | 10/1990 | European Pat. Off. . |
| 2147673 | 3/1973 | Germany . |
| 3347733 | 11/1985 | Germany . |
| 3627463 | 2/1988 | Germany . |
| 597650 | 1/1984 | Japan . |
| 62-196253 | 8/1987 | Japan . |
| 2147279 | 5/1985 | United Kingdom . |
| 2168040 | 6/1986 | United Kingdom . |

*Primary Examiner*—John Q. Nguyen
*Attorney, Agent, or Firm*—Dirk J. Veneman; Raymond W. Campbell; Gerald A. Mathews

[57] ABSTRACT

A mechanism and method for the continuous winding of a web of paper into rolls including a shear type load cell for measuring the horizontal component of the reactive force on the winding drum with the output of the load cell being used to control the nip pressure between the winding drum and the roll being wound. Another load cell measures the tension of the incoming paper web, and this measurement is subtracted to give the net nip pressure. An initial reading is taken when the core on which the web is to be wound is lowered onto the load cell and an initial reading is taken to provide the index point of the weight of the core and reel, and when the core is being pivoted downwardly over the drum, the vertical and horizontal components with the total nip load are calculated to control the nip load. Thus, the nip load is carefully controlled at all positions to provide an improved drum winder obtaining controlled nip load and controlled density of the roll being wound.

2 Claims, 2 Drawing Sheets

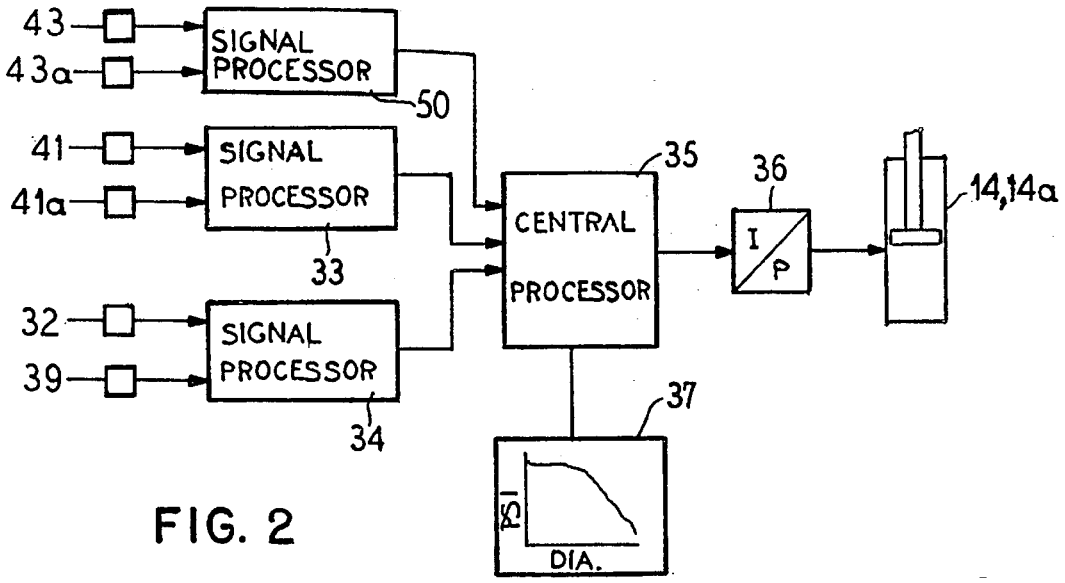
FIG. 2
FIG. 3
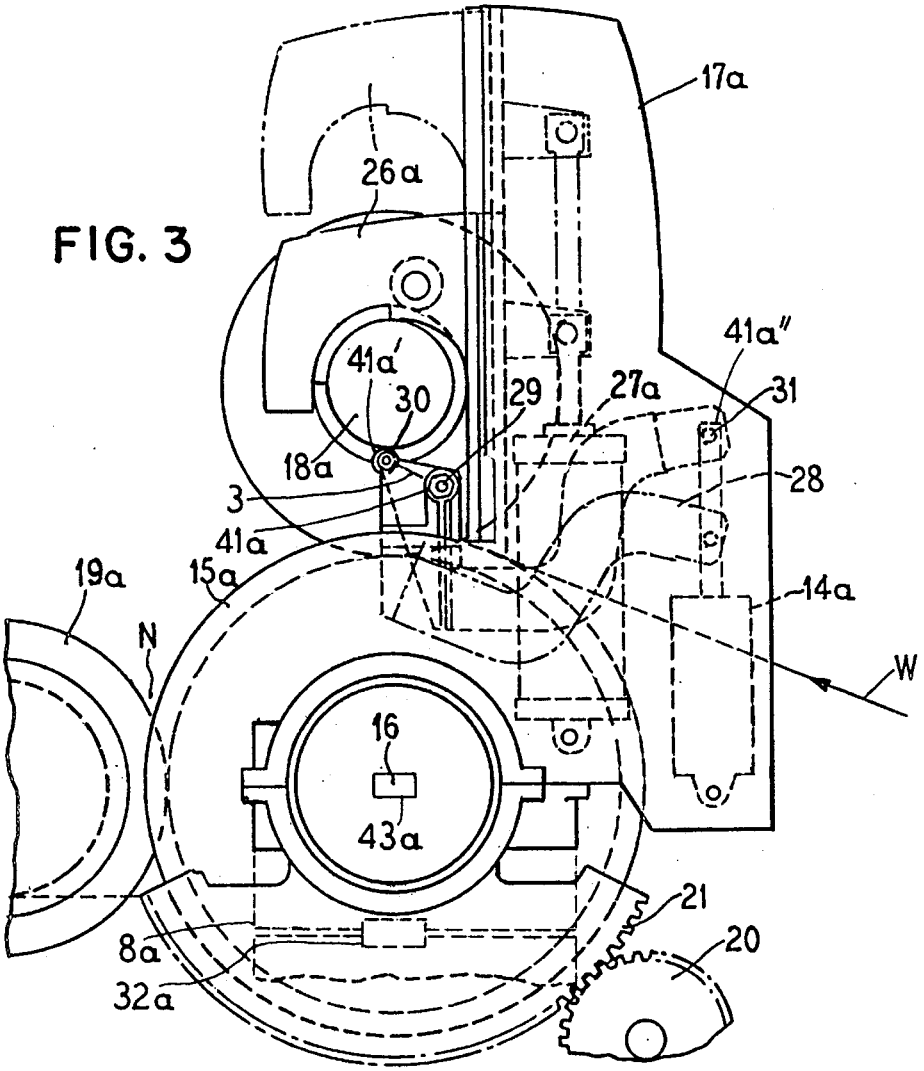

REEL WOUND ROLL LOAD SENSING ARRANGEMENT

This is a continuation of application Ser. No. 08/196,888 filed on Feb. 15, 1994, abandoned, which is a continuation of application Ser. No. 07/889,882 filed on May 29, 1992, abandoned.

BACKGROUND OF THE INVENTION

1. Field of the Invention

The present invention relates to improvements in drum winding machines and, more particularly, to a paper machine drum winder, or reel, which continually winds successive rolls from an on-coming supply of paper web, such as from a papermaking machine. Still more particularly, this invention relates to apparatus for measuring and controlling the nip load of a wound paper roll against the reel support drum.

2. Description of the Prior Art

A device of the general type for which the improvement is made is illustrated in U.S. Pat. No. 3,743,199 and includes a mechanism for bringing a new spool, sometimes called a core in the papermaking trade, into engagement with a horizontal driven winding drum on the reel in a papermaking machine, and moving the new spool downwardly from an initial position over the drum to a wound roll winding position where the spool is supported on rails while the paper roll wound on the spool is nipped against the support drum. A web is fed onto the spool until the wound roll is completed, whereupon a new spool is started and the process is repeated.

An important factor in the successive commercial winding of paper is to provide for a uniform roll structure. To do this, it is necessary to measure and control the nip level between the winding drum on the reel and the wound paper roll. This allows for a more uniform roll structure.

Present day designs for a reel usually do not have a means for directly measuring the nip level between the winding drum and the wound paper roll. Some reels have been designed with a load cell arrangement in the secondary arms. These secondary arms of a reel usually rotate through an arc, and load cells, which are commercially available and which are used in the secondary arms, only measure force in one plane. Due to the arcuate movement of the secondary arms, the orientation of load cells in the arms changes continuously such that they measure different forces for the same nip levels at different wound roll diameters. Therefore, the roll diameter and machine geometry must be known, along with the load cell reading, in order to calculate the nip level. Other efforts to measure nip load and control the nip load by the use of load cells have problems with the mechanical mounting of the load cells. In many instances, the load cells are damaged to the point where they do not function.

It is desirable to be able to control the nip level between the winding drum and the roll of paper at all times during the winding cycle, and to do this, it is necessary to continually and accurately measure the nip force between the drum and the roll being wound, and to control this nip force as a function of the measured parameters. Further, extraneous forces can have an effect on the measuring system, and these must be compensated for. Present available systems do not provide a reliable and efficient arrangement for measuring and controlling nip pressures in a winding machine.

Another problem encountered has to do with the effect of the weight of the spool on which the roll is started. It is necessary to establish this level as a reference point for measuring nip load when the roll is started and the initial core is being brought down from the starting position above the winding drum to the winding position where it is horizontally opposite the winding support drum. Tests have shown that it is very important to the successful winding of a roll that the initial starting paper web tension and nip force between the spool and support drum be accurately controlled.

Older reel designs did not utilize any means of relieving the spool weight from the winding drum once the turn-up of the on-coming web onto a new spool was done. The result was an initial nip load of 15 PLI, or higher. These nip levels can be detrimental to roll structure. While it is desired to have a nip in the range of 5–20 PLI, the nip due to the hooks or other core-securing apparatus in the arms can contribute an additional 10–15 PLI nip load. Recent designs have provided a means of relieving the weight of the reel spool/core, but they do not have any load sensing instruments and mechanism inside the primary arms for controlling the load according to the position of the core during the beginning of a wound roll. Due to sliding friction in the hook apparatus for supporting and securing the spool while the wound paper roll increases in diameter, the nip level could not heretofore be maintained with reasonable accuracy. Also, if the individual reel spool weight does not match the set-up parameter, then the actual nip level will be inaccurate.

SUMMARY OF THE INVENTION

This invention enables the operator to control the nip level between the winding drum and the reel spool/core very precisely. The object is to obtain a wound paper roll which has superior roll structure which increases its uniformity and usefulness to the trade and avoids unevenness or damage to the paper web wound on the roll. The arrangement utilizes equipment that has been used on arm designs for initially loading a spool/core onto the drum. The supporting primary arm mechanism is adapted by placing a load cell in the arm structure or linkage, according to the configuration, and the load cell provides a primary output signal sent to a signal processor. This signal is taken to a central processor to establish a set point value and the estimated empty spool/core weight. Other instruments establish the primary arm angular position and signal the central processor with this information.

The operator loads the empty reel spool/core onto the primary arms in their extended position. The primary arm nip relieving cylinder then operates to relieve the core weight, and the load cell continually measures the load exerted by the weight on the cylinder. When the load does not appreciably increase, then the pressure required to lift the core completely off the winding drum is known. This can be done automatically for each individual spool/core. With the minimum friction in the hook or core clamping apparatus in the primary arms, the hydraulic or pneumatic pressure in the nip relieving cylinder then can be lowered such that a known nip level exists between the winding drum and the core.

The load cell selected is a directional transducer which measures the force in only one plane, and in that way, the nip level can be continuously monitored when the paper is building up on the core as the primary arms, which support the spool/core, are pivoted to move the core and roll down to the secondary position, which is the winding position. All of the weights and forces are broken down into vertical and horizontal components at the nip between the wound paper roll and support drum. This provides for a smoother transition between the secondary arm loading and the primary arm loading. The arrangement is well adapted to be retrofitted into existing primary arms on reels which are now in the field.

When the core has been moved down to the winding position horizontally opposite the driven winding drum, the nip force is continually measured and controlled. For measuring the nip force, the reaction force on the drum is measured by supporting the core journals on bearings and measuring the shear force on the load cell in the drum support mounting. This shear force in the support drum load cell is the horizontal component due to the nip force between the wound paper roll and the support drum. Thus, the horizontal component of this nip force can range from 0, when the core is vertically above the rotational axis of the support drum, to the nip force when the core and wound paper roll is supported on the rails horizontally of the rotational axis of the support drum.

There is also a component of force acting on the nip, when the web is received onto the support drum horizontally, or substantially horizontally, which force component is due to sheet tension and the loading of the primary arms of the core against the support drum. Since the paper web wraps the support drum for approximately 120°, there are both horizontal and vertical force components on the drum due to web tension. The present arrangement provides load cells located directly in advance of the winding drum supporting a roll in engagement with the web to measure the web tension as the web is received onto the drum. With a known wrap angle on the winding drum, the sheet tension component can be determined and subtracted from the horizontal reaction force on the drum. As to the effect of the loading of the primary arms of a reel, the angular position of the primary arms as the roll is brought down into the winding location can be programmed and taken into consideration by a central processor into which the signals are fed. The central processor has an output which controls the pneumatic/hydraulic cylinder that controls the force applied to control the nip pressure.

Since the friction in the core-securing hook, or other apparatus in the arms, varies with time, and since there may be a hysteresis effect as the core-securing mechanism moves outwardly and returns inwardly, knowledge of this friction force is important to its control and effect on the wound paper roll nip.

It is accordingly an object of the invention to provide a means for measuring the initial nip level between the winding drum and the reel spool/core to provide a primary output signal of nip level so as to control the start of winding, which is one of the most critical areas for roll structure.

A further object of the invention is to provide an improved means of measuring nip load during winding as a continuous operation throughout the process and to control the nip forces as a predetermined programmed function of the measured nip load.

A still further object of the invention is to provide a method and structure capable of utilizing load cells for measuring nip load to accurately sense and control nip pressure in a reel for winding a wound web roll.

Other objects, advantages and features will become more apparent with the teaching of the principles of the invention in connection with the disclosure of the preferred embodiments in the specification, claims and drawings.

BRIEF DESCRIPTION OF THE DRAWINGS

FIG. 2 is a diagrammatic showing of a signal processing arrangement for measuring and controlling the nip force.

FIG. 3 is a somewhat schematic side-elevational view of a portion of the winding mechanism somewhat similar to that of FIG. 1, but showing another embodiment for securing the core in the primary arms.

DESCRIPTION OF THE PREFERRED EMBODIMENTS

Figure 1:
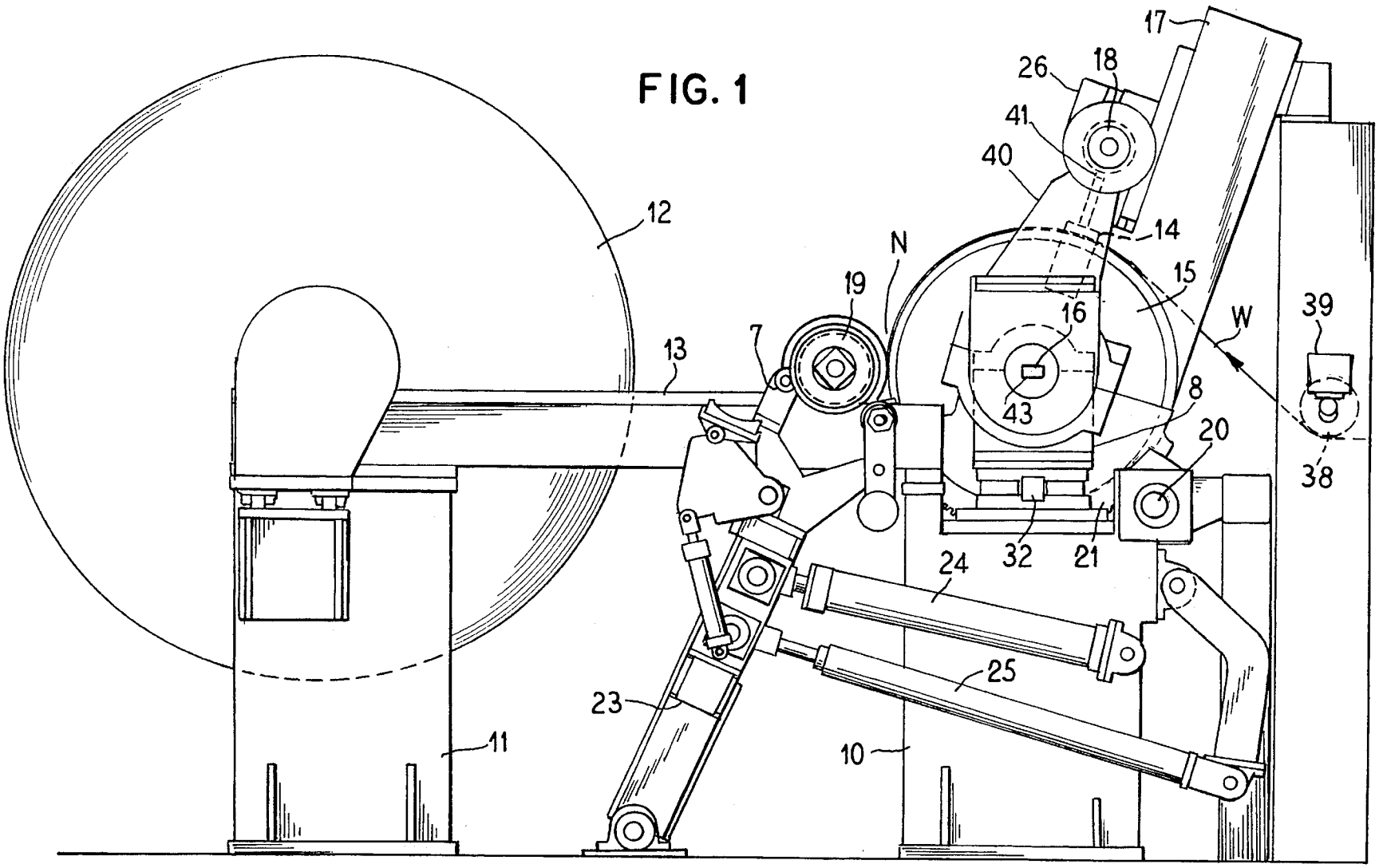
FIG. 1 is a side-elevational view, shown in somewhat schematic form, of a reel winding mechanism embodying the principles of the present invention and showing one embodiment of mounting a core in the primary arms of a reel.

While the principles of the invention are universal, the practical embodiment of the invention can take either of two general forms. FIG. 1 illustrates an embodiment wherein the spool, or core, 18 is supported directly by a pressure cylinder 14 in conjunction with a core holder support 40 in the primary arms 17.

In the embodiments shown in FIGS. 1 and 3, corresponding parts will be correspondingly designated with alphabetical suffixes following the individual numerical designations to distinguish between them. Also, it will be understood that the apparatus is symmetrical such that both ends of the core are supported and moved by similar equipment at both ends on either side of the apparatus.

Accordingly, in FIG. 3, the core **18*a* is held in the primary arms 17*a* by hooks 26*a* which are actuated by a pressure cylinder 27*a*. The core is supported from below and secured in the hooks by action of a second pressure cylinder 14*a*** as will be explained in more detail below.

As illustrated in FIGS. 1 and 3, a spool/core 18, **18*a* is first positioned into the machine being supported on primary arms 17,17*a* and secured from above by hooks 26,26*a*. The winder as a whole is supported on pedestals 10 and 11, as shown in FIG. 1, with a completed wound paper roll 12 which is rotatably supported on parallel horizontal side rails 13**.

A continuous web W is fed substantially horizontally into the reel over tension roller 38, such as from a papermaking machine, and passes over the top of a winding support drum 15,**15*a* to enter a nip N between a paper web wound roll 19,19*a*, being wound onto a core, and the drum 15,15*a***.

The winding drum is power driven by suitable means, such as a motor, not shown, and is supported for rotation about a horizontal axis 16 on a shaft journaled in bearings. A load cell 32 is positioned between the mounting for the drum bearings, such as a bearing housing 8, and the pedestal 10 such that the horizontal reaction force due to the force in the nip N is measured only as a shear force between the support drum bearing housing, or mounting, 8 and the pedestal 10. That is to say, the load cell 32 does not measure any vertical force component, whether the force is due to the weight of the support drum and its bearing housing, due to friction of the hooks sliding in the primary arms, or due to the weight of the core, including the weight of the paper wound on the core, when the core is in any position above a horizontal plane through the support drum rotational axis 16. The horizontal reaction force measured by load cell 32 is due to slight movement, or deflection, of the bearings, or bearing housing 8, horizontally relative to pedestal 10.

As a core 18,**18*a* is first loaded into the reel, it is carried on primary arms 17,17*a* between hooks 26,26*a* on one side, and other support structure on the other side, depending on the embodiment as shown in either FIG. 1 or FIG. 3. The core is secured in place by moving the hooks 26,26***a* which are slidably mounted in the primary arms and which are movable by action of a cylinder 14,27*a*, which may be either pneumatically or hydraulically actuated.

When the turn-up of the web onto a new core has been effected, the new wound web roll is gradually lowered from its initial position above the support drum onto the support drum and eventually rotated by the primary arms into a second position where the core is supported on horizontal rails 13 with the wound roll 19,19*a* in nipping engagement with the support drum 15,15*a*.

In the embodiment shown in FIG. 1, the core is clamped between an upper hook 26 and a lower core holder 40 which is brought into supporting engagement with the lower portion of the core by a pressure cylinder 14 on which a load cell 41 is mounted to measure the weight of the core in conjunction with the weight or force of the hooks 26, and any frictional sliding resistance of the hooks in their primary arms. In this embodiment, the core and related weights and forces bear directly on the load cell 41 mounted on the ends of the rods of pressure cylinders 14. The force measured is parallel, or coaxial, with the rod of the pressure cylinder 14.

In the embodiment shown in FIG. 3, the core is lowered onto the rotating drum 15*a* by an arm 28 operated by a pressure cylinder 14*a*. The arm 28 is pivoted at 29, and the rod of pressure cylinder 14*a* is pivotally connected to the arm 28 at 31. A support roller 30 on the distal end of arm 28 supports the core 18*a* as it is lowered onto the drum 15*a*. A load cell, generally designated as item 41*a*,41*a*', 41*a*", can be located at any of positions 29,30 or 31, respectively, to provide the same signals indicative of force as the signals provided by load cell 41. That is, only one load cell is needed, but it can be located at any of locations 41*a*,41*a*', 41*a*".

Regardless of the location of the load cell 41*a*,41*a*',41*a*" at points 29,30,31, it is capable of measuring the linear vertical force between the load cell and the spool/core 18. After the core is loaded into the primary arms, supported by the end of arm 28 from below and engaged from above by hooks 26*a*, which are actuated by retracting pressure cylinder 27*a*, the pressure cylinder is retracted slowly (cylinder 14*a* in FIG. 3), or extended slowly (cylinder 14 in FIG. 1). This produces a load on the load cell 41*a*,41*a*',41*a*" indicative of the same load as described in conjunction with load cell 41 in FIG. 1.

As shown in FIG. 3, pressure cylinders 14*a*, arms 28, pivots 29 and 30 comprise the primary arm nip relieving mechanical unit. After the core 18*a* has been clamped into the primary arms by the hooks, the primary arm nip relieving system is actuated by either extending cylinder 14 (FIG. 1) or retracting cylinder 14*a* (FIG. 3).

During this time, the load cell 41,41*a*,41*a*',41*a*" measures a value that establishes a reference value which shows the empty core weight plus the friction associated with the movement of the primary arm hook 26,26*a* in the unload or paper build-up direction. Cylinder 14 retracts (FIG. 1) or cylinder 14*a* extends (FIG. 3) until the core is resting on core holder 40. The signal from the load cell 41,41*a* measuring the weight of the core at either the end of the piston rod on pressure cylinder 14 (FIG. 1) or the distal roller support 30 of arm 28, or pivots 29,31 (FIG. 3) is fed into a signal processor 33, as shown in FIG. 2, which feeds its signal into a central processor 35. The nip load signal, and web tension signal, which will be described in more detail later, from load cells 32 and 39 (FIG. 1) are fed into a signal processor 34 which, in turn, signals central processor 35. The angular orientation of the primary arms is reported by a signal which is produced by an angular position indicator 43,43*a* and relayed to signal processor 50 which, in turn, signals central processor 35. The central processor is programmed with a desired program or algorithm which relates the desired wound roll nip load against the drum as a function of its angular position on the drum. Thus, the central processor controls a pneumatic/hydraulic pressure control mechanism 36 which controls a pneumatic or hydraulic cylinder 14,14*a* to control the nip load while the core is held in the primary arms at any point over the arcuate segment of the support drum 15,15*a* down to where the core is supported on the horizontal rails.

Referring now again to FIG. 1, once the set point has been established by the loading of the core against the load cell 41, the core is moved down to the winding position shown by the partially wound roll 19 supported on the horizontal rails 13 in nipping engagement with the support drum 15. The force of the nip is measured by the reaction force on the load cell 32. Since the nip between the wound roll and the support drum is horizontal and is substantially in a horizontal plane through the rotational axis 16 of the support drum, the reaction force is seen by the load cell 32 as a shearing force at right angles to an imaginary vertical plane through this load cell. This shearing force is the sum of the horizontal force in the nip combined with the horizontal component of the web tension force. The readout from the load cell 32, combined with the other readouts, are translated into pneumatic or hydraulic pressures for the cylinders 24 and a roller 7, carried on pivotal arms 23 which bear against the core so as to control the nip force N. Connecting rod 25, one of which is on either side of the reel, maintains pivot arms 23 in cross-machine alignment.

The tension in the in-coming web W is measured by a roller 38 against the web supported by a load cell 39. It will be understood, of course, that for convenience, only the front end of the machine is shown, and similar load cells will be positioned on either both the front and back of the machine or in multiple locations distributed across the face of the machine. At a minimum, a load cell, such as 39, will be positioned at each side of the web on either side of the machine.

Load cell 32 will be positioned beneath the bearing mounting of the support drum 15 on either end of a support drum at either side of the machine. Also, load cell 41 will be positioned on the other end of each primary arm 17,17*a* so as to measure the force at both ends of the core 18. The core relief and loading mechanism (i.e. load cell 41) for measuring the weight of the core and obtaining the set point value is directly on the end of the pressure cylinder 14 rod in the arrangement shown somewhat schematically in FIG. 1, whereas the articulated lever arrangement of this mechanism (i.e. load cells 41*a* or 41*a*' or 41*a*") shown in FIG. 3 is in more detail.

In operation, the operator loads a core 18 into the primary arms 17,17*a* where it is supported by core holder 40 and the hooks 26 (FIG. 1) or the distal end 3 of arm 28 and hooks 26*a* (FIG. 3). The hooks 26,26*a* are engaged over the core by retracting cylinders 14,27*a*. The distal end 3 of arm 28 engages the core by action of cylinders 14*a* being retracted, as shown in FIG. 3, or by action of cylinder 14 being extended, as shown in FIG. 1. During this time, the load cell 41,41*a*,41*a*',41*a*" measures a value which establishes a reference value set point which shows the empty reel spool/core weight plus the friction associated with the movement of the primary arm hooks in the so-called unload, or paper build-up, direction. That is, in the direction radially outwardly from the support drum 15. This reference value is fed into the signal processor 33 in FIG. 2 to pass into the central processor 35. The cylinder 14,14*a* operates until the core is resting on core holder 40. The primary arms are then rotated counter-clockwise by a pinion 20 driving a gear segment 21 to bring the core down to the winding location shown as partially wound roll 19. At all points along this arcuate path of travel, load cells 41,41*a* (or 41*a*' or 41*a*") produce signals indicative of the load of the partially wound web roll nip against the support drums 15,15*a*. This load is controlled by pressure cylinder 14,14*a*. The reaction force on the drum 15 is measured by the load cell 32,32*a*, and its signal is fed to the signal processor 34, as shown in FIG. 2. The web tension force measured by the load cell 39 is subtracted from the force on the load cell 32,32*a* to provide a net reading of nip force N. The combination of signals are fed to the central processor 35 which produces a control pneumatic/hydraulic signal by the current/pressure device 36 so that the pneumatic or hydraulic cylinders apply the proper control force to obtain a desired, preprogrammed nip pressure. The location of the primary arms is constantly monitored by angular position indicators 43,43*a*, which signal their location to the central processor 35. All of these operations are controllable by the operator to obtain an optimum roll density.

Reference is made to the use of load cells and, as will be fully appreciated by those versed in the art, load cells are commercially available devices which are readily available to one practicing the invention. As an example, a Pillow Block Tension measuring system is commercially available from ABB Industrial Systems, Inc., providing a load cell. Another load cell is sold by Nobel Elektronik of Karlskoga, Sweden. The ABB load cell would be well suited for use to measure the reaction force on the winding drum, and the Nobel load cell would be well suited for use in the apparatus for measuring the index point of the weight of the core.

Thus, it will be seen that there has been provided an improved mechanism utilizing load cells, which are particularly well adapted to reliable operation in high speed papermaking machine reels. The load cells provide a continual accurate output, and enable the production of wound paper rolls having uniform density.

I claim as my invention:

1. A paper web reeling apparatus, including a pair of primary arms for receiving a core and a driven support drum having a surface and an axis of rotation for supporting the traveling paper web when the core is held in the primary arms and brought into nipping engagement with the support drum with the web therebetween to wind the web into a wound web roll on the core, the combination comprising:

the pair of primary arms are mounted co-axially with the support drum to rotate substantially co-axially with the support drum and to extend substantially radially of the axis of rotation;

nip force control means operatively associated with the primary arms for receiving and holding a core in movable adjustably biased nipping engagement with the support drum, the core being substantially arcuately movable about an upper segmental portion of the support drum surface to commence the winding of the web onto the core to form a partially wound web roll thereon;

first pressure sensing means operatively associated with the primary arms and nip force control means for sensing the weight of the core and any frictional force of the nip force control means in movement away from the support drum when the nip load between the core and support drum is adjusted to a desired level initially when the fresh core is positioned in the primary arms substantially vertically above the support drum, as well as any frictional force by the nip force control means as it moves to accommodate an increasing diameter of the wound web roll, said first pressure sensing means providing a first signal indicative of such core weight and frictional force as the web is wound on the core and the diameter of the wound web roll increases;

second pressure sensing means associated with the support drum for only measuring any horizontal force on the support drum including any horizontal component of a radial force of the core or partially wound web roll against the support drum and providing a second signal indicative of the horizontal nip force against the support drum;

angle position indicator means for measuring the angular position of the newly started core about the support drum axis of rotation and relative to the support drum surface, and for providing a third signal indicative of such position;

signal processor means for receiving the first, second and third signals, and for introducing the signals as data into a program in a central processor and for providing a first control signal determined by the program to the nip force control means to control the nip pressure between the core, the web roll wound thereon, and the support drum according to the program as the partially wound web roll is moved by the pair of primary arms about an upper segment of the support drum such that the paper web is supported on a segment of the support drum surface while being held by the nip force control means;

web tension measuring means disposed to measure the web tension of the on-coming paper web upstream of the web supported on the support drum, said web tension measuring means including a load cell for providing a fourth signal as a function of web tension;

said signal processor means receiving the fourth signal and comparing it with the second signal to provide a second control signal indicative of the net reaction force on the support drum due to the horizontal force component of the partially wound web roll against the support drum less the horizontal force component of the tension force of the on-coming web;

whereby the nip force control means controls the nip load between the web roll being wound and the support drum as a function of the first and second control signals.

2. A method of winding a continuously traveling paper web in a web reeling apparatus, including a pair of primary arms for receiving a core and a driven support drum having a surface and an axis of rotation for supporting the web when the core is brought into nipping engagement with the support drum with the web therebetween to wind the web into a wound web roll on the core, comprising the steps:

receiving a fresh core between radially inwardly biased hook means for securing said core and support means for supporting said core in the primary arms, movably controlled by nip force control means to selectively hold the fresh core in nipping engagement with the support drum and to release the fresh core, the fresh core positioned by the primary arms about an upper peripheral segment portion of the support drum surface to maintain the core in controllably nipped engagement with the support drum surface;

providing a first signal utilizing first pressure sensing means for sensing the weight of the core and any frictional force of the nip force control means in movement of the core away from the support drum as the web is wound on the core and the diameter of the wound web roll increases;

moving the fresh core inwardly against the support drum to establish a nipping engagement therewith, with the traveling paper web therebetween, by the nip force control means in adjustably biased nipping engagement with the support drum;

winding the paper web on the core to form a partially wound web roll as the web roll is nipped with the support drum;

moving the core in an acruate path about the periphery of the support drum while maintaining nip contact between the paper web roll being wound onto the core and the support drum while continuously measuring the nip load by first pressure sensing means;

providing a second signal utilizing second pressure sensing means operatively associated with the support drum to measure a horizontal force against the support drum caused by the web roll nipped against the support;

measuring the angular position of the newly started core about the axis of rotation relative to the support drum surface;

providing a third signal indicative of such angular position;

processing the first, second and third signals and introducing these signals as data into a program in a central processor and providing a first control signal determined by the program to the nip force control means to control the nip pressure between the core and the web roll wound thereon and the support drum according to the program;

measuring the tension of the web at a location upstream of the support drum;

providing a fourth signal indicative of the web tension;

processing and comparing the second and fourth signals in the central processor to provide a second control signal indicative of a net reaction force on the drum resulting from the nip pressure against the wound web roll being formed adjusting the nip load by the nip force control means against the support drum as a function of the first and second control signals as determined by the program.

* * * * *